US006662447B2

(12) United States Patent
Kuschel et al.

(10) Patent No.: US 6,662,447 B2
(45) Date of Patent: Dec. 16, 2003

(54) METHOD AND APPARATUS FOR THE PRODUCTION OF DOUBLE-WALLED HOLLOW SECTIONS BY MEANS OF INTERNAL HIGH-PRESSURE FORMING

(75) Inventors: Stephan Lothar Kuschel, Hamburg (DE); Stefan Schwarz, Buxtehude (DE)

(73) Assignee: DaimlerChrysler AG, Stuttgart (DE)

( * ) Notice: Subject to any disclaimer, the term of this patent is extended or adjusted under 35 U.S.C. 154(b) by 153 days.

(21) Appl. No.: 09/810,342

(22) Filed: Mar. 19, 2001

(65) Prior Publication Data

US 2001/0037573 A1 Nov. 8, 2001

(30) Foreign Application Priority Data

Mar. 17, 2000 (DE) ..... 100 13 428

(51) Int. Cl.[7] ..... B23P 17/00

(52) U.S. Cl. ..... 29/890.08; 29/418; 29/421.1; 29/455.1; 29/522.1; 29/523; 72/58

(58) Field of Search ..... 29/890.08, 421.1, 29/418, 455.1, 523, 522.1; 72/58, 61, 62

(56) References Cited

U.S. PATENT DOCUMENTS 3,756,053 A * 9/1973 Hill et al.
4,137,743 A * 2/1979 Schwarze
4,776,075 A * 10/1988 Kawabata et al. ..... 29/418
5,170,557 A * 12/1992 Rigsby ..... 29/890.08
5,555,762 A * 9/1996 Kawamura et al.
6,026,570 A * 2/2000 Bohm et al. ..... 29/890.08
6,349,468 B1 * 2/2002 Bonny et al. ..... 29/890.08

FOREIGN PATENT DOCUMENTS

DE 19752772 A1 6/1999

* cited by examiner

*Primary Examiner*—P. W. Echols
(74) *Attorney, Agent, or Firm*—Crowell & Moring LLP

(57) ABSTRACT

The invention relates to a method and apparatus for the production of double-walled hollow sections by means of internal high-pressure forming, a first hollow section being inserted into a second hollow section, after which the double-walled hollow section thus formed is subjected to high internal fluid pressure in such a way in an internal high-pressure forming die that the double-walled hollow section is expanded. During this process, an air gap is formed between the first, inner, hollow section and the second, outer, hollow section. In order to produce double-walled hollow sections with an air gap between the inner and the outer hollow section in a simple manner and with a reduced process time, the proposal is to position the inner hollow section in a defined manner in the outer hollow section during insertion, forming a gap, to introduce an intermediate layer between the inner hollow section and the outer hollow section, filling the gap, and, after expansion of the double-walled hollow section by internal high-pressure forming, to dissolve the intermediate layer out of the hollow section via an opening formed at least in one of the hollow sections, opening up the gap as an air gap.

23 Claims, 1 Drawing Sheet

METHOD AND APPARATUS FOR THE PRODUCTION OF DOUBLE-WALLED HOLLOW SECTIONS BY MEANS OF INTERNAL HIGH-PRESSURE FORMING

BACKGROUND AND SUMMARY OF THE INVENTION

This application claims the priority of German application 100 13 428.9, filed Mar. 17, 2000, the disclosure of which is expressly incorporated by reference herein.

The invention relates to a method for the production of double-walled hollow sections by means of internal high-pressure forming. The invention more specifically relates to a method involving the use of a removable intermediate layer between an inner hollow section and an outer hollow section during a single internal high-pressure forming stage.

A method of the generic type is known from DE 197 52 772 A1. In this method, two tubes are slid one inside the other to give almost play-free seating of the outer tube on the inner tube. The double tube thus formed is then placed in a first internal high-pressure forming die and, once the die has been closed, is subjected to internal high pressure in such a way that, at the location of a freely projecting branch in the die cavity, double-walled material of the double tube is forced into this branch to form a double-walled neck. After the relief of the pressure on the pressurized fluid, the internal high-pressure forming die is then opened and the formed double tube is removed. The double tube is then placed in a second internal high-pressure forming die, the cross section of the cavity of which is enlarged close to the ends of the double tube compared with the cross section of the cavity of the first forming die, the enlargement extending over the entire length of the cavity, including the branch. Once the second forming die has been closed and the ends of the double tube have been sealed by axial rams in a clamping action, the double tube is once again subjected to internal high pressure. The inner tube, which has perforations outside the clamping location, remains undeformed by virtue of the pressure balance that is established between the interior of the inner tube and the inside of the outer tube owing to the perforations, while only the outer tube is expanded by the internal high pressure and comes to rest against the cavity of the second internal high-pressure forming die, following its contours accurately. Owing to the indicated difference in the behaviour of the inner tube and the outer tube in relation to the internal high pressure, i.e. the exclusive expansion of the outer tube, a gap is formed on all sides between the clamped ends of the double tube. Once the forming of the double tube in the second forming die has taken place and the double tube has been removed after the opening of the die, an air gap is formed. In the case of exhaust lines as an example, this air gap is intended to insulate the outer tube and the surroundings of the exhaust line, which are accessible to anyone, from the heat of the exhaust gas, which is transferred to the inner tubes that carry the hot gas. This air gap is also intended to ensure an early response from the downstream catalytic converter when cold starting by reducing heat dissipation from the inner tube to the surroundings.

However, the known embodiment described above involves complex apparatus since two dies have to be used to form the double-walled tube. It also requires an undesirably long process time for the overall forming process due to the transfer between the two dies of the workpiece to be formed, the opening time of the first die and the closing time of the second die, and the pressure build-up time in both dies.

An object of the invention is to provide a method of the above-described type such that double-walled hollow sections with an enlarged cross section and with an air gap between the inner and the outer hollow section can be produced in a simple manner in a reduced process time.

This object is achieved according to the invention disclosed and claimed below.

According to one preferred method of the present invention, an inner hollow section is positioned in an outer hollow section, forming a gap which is filled by an intermediate layer and thus forming a double-walled hollow section. After expansion of the double-walled section by internal high-pressure forming, the intermediate layer may be removed from between the inner hollow section and the outer hollow section to create an air gap therebetween.

By means of the intermediate layer between the individual hollow sections that form the double-walled hollow section after being slid one inside the other, the invention creates the prerequisites for an air gap between the hollow sections without the need to carry out internal high-pressure forming for this purpose. In this context, an appropriate choice of dimensions must be made for the cross sections of the two hollow sections to enable an air gap to form in an appropriate manner at a later stage after the internal high-pressure forming that produces the enlargement in the cross section of the two hollow sections and after the intermediate layer is dissolved away. The intermediate layer makes the two hollow sections virtually integral, allowing forming for the purpose of enlarging their cross section to be accomplished uniformly and in a reliable process despite the spacing of the two hollow sections. The intermediate layer need only be dissolved away in a simple manner, the positioning of the hollow sections relative to one another resulting from the forming process either being retained unaltered by end clamping, with no further means being employed, or, where clamping is not used, being maintained by simple holding means at the ends. Thus, the air gap is created by dissolving away the intermediate layer.

Since, according to the invention, the formation of the air gap does not require any forming of the hollow sections, only a single forming die and a single forming step are required to produce the hollow section with air-gap insulation by means of the spacing of the individual hollow sections. The single die and forming step are used solely for the purpose of enlarging the cross section. Thus, due to the elimination of a further forming step, the process time and hence costs for the production of the hollow section are significantly reduced.

Expedient refinements of the invention can be taken from the subclaims; the invention is furthermore explained in greater detail below by means of a number of exemplary embodiments illustrated in the drawings:

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
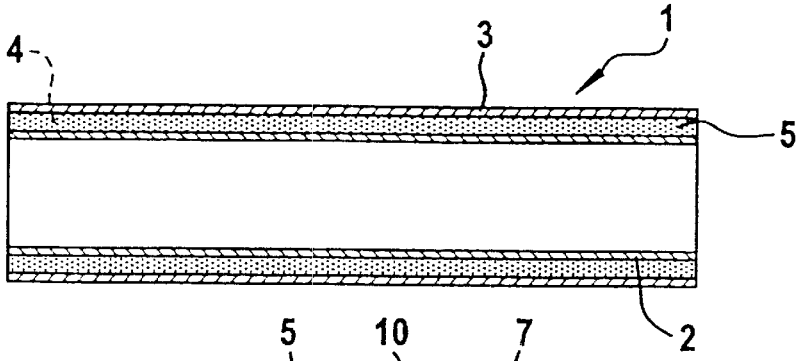
FIG. 1 shows a side sectional view of a double-walled hollow section according to the invention before the single forming step.

FIG. 1 shows a double-walled hollow section 1, which runs in a straight line and is of cylindrical construction in its initial state. The hollow section 1 comprises an inner first hollow section 2 and an outer second hollow section 3, which are generally both of the same length and can be composed of a steel material or a light alloy. The first hollow section 2 is inserted into the second hollow section 3. The two hollow sections 2 and 3 are positioned coaxially with one another, an annular gap 4 extending over their entire length being formed between them owing to the difference in the size of their cross sections. In this annular gap 4 there is an intermediate layer 5 that completely fills the annular gap 4. The intermediate layer 5 can be composed of salt, wax, a metal that melts at a lower temperature than steel or aluminium, or plastic, but preferably an ice. The ice could be dry ice. Within the context of the invention, it is not essential that an annular gap 4 be formed between the two hollow sections 2 and 3. The two hollow sections 2 and 3 may also rest against one another along their length in one section of their walls while being spaced apart from one another in the remaining sections to form a longitudinal gap of crescent-shaped cross section.

There are various ways of producing the double-walled hollow section. One possibility is to cover the inner hollow section 2 with a layer of a low-melting metal, wax, plastic or frozen water by dipping the hollow section 2 into a container with an all-round gap relative to the inner wall of the container and then pouring one of the above media into the gap in the liquid state. The container, hollow section 2 and liquid substance is then cooled, in the case of water in a cooling chamber that can be adjusted to negative temperatures (Celsius). The gap should correspond approximately to the subsequent annular gap 4 between the inner hollow section 2 and the outer hollow section 3, so that the thickness of the layer that solidifies in the cooled state coincides approximately to the width of the annular gap 4. The hollow section 2 coated in this way is removed from the container and then slid or, where there is no clearance, forced into the outer hollow section 3. It is advantageous here that the inner hollow section 2 centers itself in the outer hollow section 3 by virtue of the circumferentially uniform layer thickness, thus eliminating the need for any further positioning means.

Another approach is to insert the hollow section 2 into the outer hollow section 3 first. Here, it would be necessary to align the hollow section 2 coaxially with a relatively high degree of accuracy in the hollow profile 3 and hold it there by holding means. After temperature-stable sealing, of at least one of the ends of the double-walled hollow section 1, one of the above-mentioned substances is then introduced into the annular gap 4, in liquid form, and cooled to below the solidification temperature of the respective substance, thereby leading to the formation of the intermediate layer 5. It is preferred that the solidified medium adheres both to the inner hollow section 2 and to the outer hollow section 3 such that holding means are then no longer required. This also results in full contact between the medium and the hollow sections 2 and 3, this being advantageous for simultaneous expansion of the hollow sections 2, 3 and process reliability owing to the non-displaceability of the medium during subsequent internal high-pressure forming.

It is also possible, as described in the previous example, to insert the hollow section 2 into the hollow section 3 in a defined manner and hold it there. A sleeve of the same length as the inner hollow section 2 is then slid or forced into the annular gap 4. The sleeve can be produced from salt, wax, a metal that melts at a lower temperature than steel or aluminium, plastic or ice and its wall thickness must of course correspond to the width of the annular gap 4. As an alternative, it is also possible to slip the sleeve over the inner hollow section 2 and then insert it as a unit together with the latter into the outer hollow section 3, this having the advantage that it involves little positioning effort. The sleeve technique simplifies the process for the production of the double-walled hollow section 1 according to the invention since the sleeve can be produced in large numbers in advance and stored and need only be inserted between the hollow sections 2, 3. This allows a particularly short process time for the production of the hollow section 1.

Figure 2:
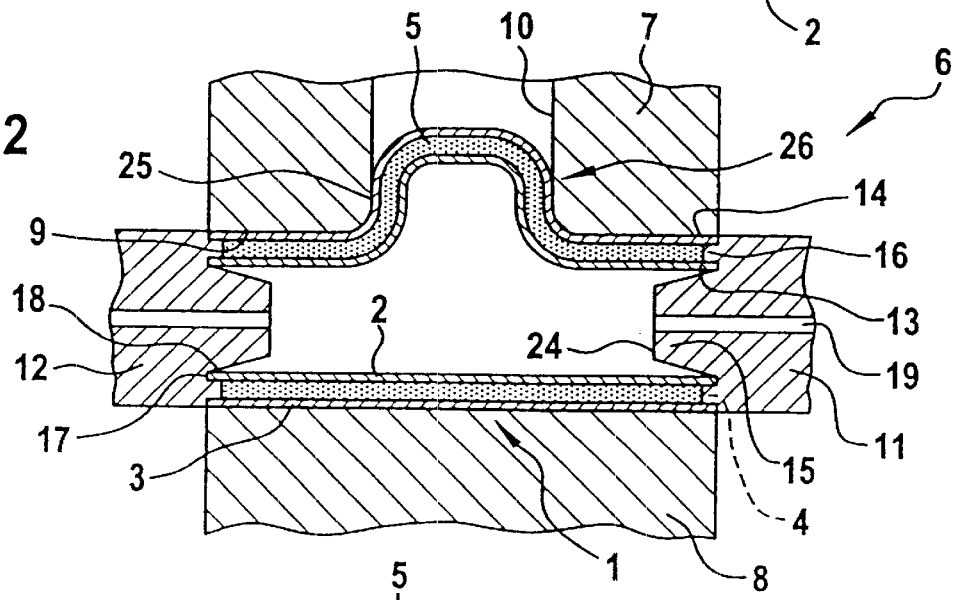
FIG. 2 shows a side sectional view of the hollow section from FIG. 1 in the internal high-pressure forming die after the forming step with the ends unclamped.

In the forming stage, the double-walled hollow section 1 provided with an intermediate layer 5 is placed in an internal high-pressure forming die 6, which comprises a top die 7 and a bottom die 8, as shown in FIG. 2. The top die 7 has a branch 10, which extends radially away from the rectilinear cavity 9 of the forming die 6 and in which a counter plug (not shown here) is guided, supporting the hollow section 1 during expansion. Once the forming die 6 has been closed, two axial rams 11 and 12 are inserted into the ends 13, 14 of the hollow sections, which are sealed by the rams. The inserted ends 15 of the axial rams 11, 12 are of tapered design, these ends 15 projecting freely into the inner hollow section 2 in FIG. 2. The ends 15 are surrounded by an annular collar 16, which projects from the front of the axial rams 11, 12 and engages in the annular gap 4 between the hollow sections 2 and 3. The inner hollow section 2 rests on the base 17 of an annular groove 18 adjoining the annular collar 16 towards the tapered end 15 of the axial rams 11, 12, thus ensuring adequate sealing at this point too. Extending through the axial rams 11, 12 is a central passage 19 for introducing and discharging the pressurized fluid into and from the inner hollow section 2, this passage opening into the front 24 of the ends 15 of the rams.

Figure 3:
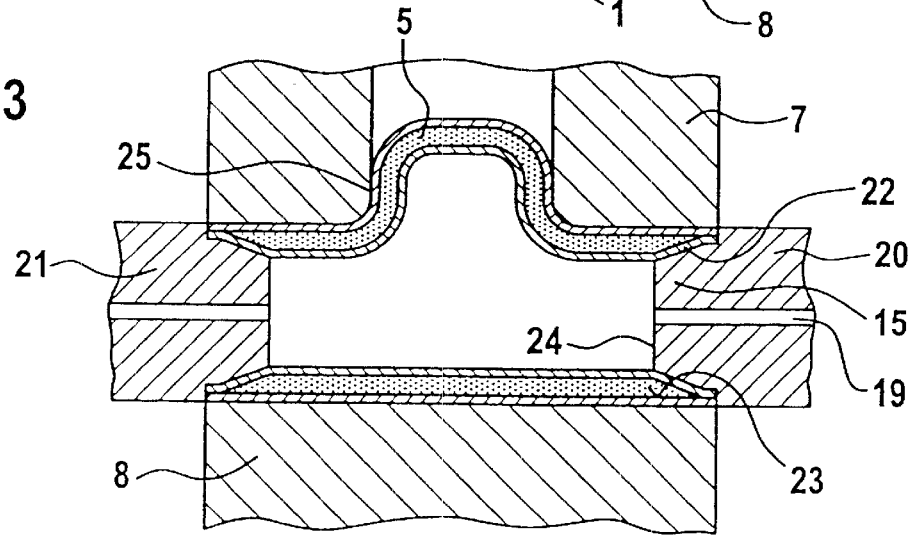
FIG. 3 shows a side sectional view of the hollow section from FIG. 1 in the internal high-pressure forming die after the forming step with the ends clamped.

While, in FIG. 2, the ends of the hollow sections 2, 3 remain spaced apart even while the axial rams 11, 12 are docking, the axial rams 20, 21 of the apparatus in the exemplary embodiment in FIG. 3 are configured in such a way that the end 22 of the inner hollow section 2 is expanded during insertion and is clamped to the outer hollow section 3 on the inside 23 of the latter. In this case, the annular gap 4 is closed all the way round. The annular collar 16 of the apparatus shown in FIG. 2 is omitted in this embodiment.

Figure 4:
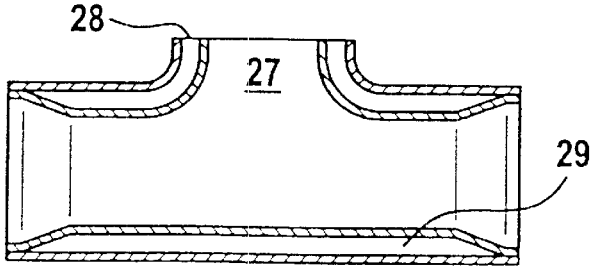
FIG. 4 shows a side sectional view of the hollow section from FIG. 3 after removal from the internal high-pressure forming die and with the intermediate layer dissolved away.

After the docking of the axial rams 11, 12 and 20, 21 with the hollow section 1, a pressurized fluid under high pressure (generally >500 bar) is introduced into the inner hollow section 2 via the central passage 19 in the rams, expanding the hollow section 1 in the region of the branch 10 of the cavity 9 of the forming die 6 into the shape of a neck 25 deformed into the branch 10, and thereby enlarging its cross section. After removal of the axial rams 11, 12 and 20, 21 and relief of the pressure on the pressurized fluid, the formed hollow section 1 is removed from the forming die 6 and the cap region 26 of the neck 25 is cut off by a horizontal cut, preferably by means of a laser. This gives rise to a through opening 27, as shown in FIG. 4, in the inner hollow section 2, opening to the outside via the neck 25—for purposes of using the hollow section 1 in the exhaust line of a motor-vehicle engine as an exhaust manifold element with air gap insulation or in body construction as a plug-in framework structure element, for example, —and, on the other hand, in the case of the exemplary embodiment shown in FIG. 3, to form an opening 28 in the closed annular gap 4 to enable the intermediate layer 5 to be dissolved away via this opening. For the exemplary embodiment shown in FIG. 2, this is unimportant since the annular gap 4 has remained open owing to the fact that there is no clamping at the ends of the hollow sections 2,3, the opening 28 here being formed by the open ends of the hollow sections 2,3. If trimming of this kind is not wanted, it is possible to form the opening 28 before or after the forming step by means of holes in the inner and/or outer hollow section 2, 3. This can be accomplished outside the forming die 6, for example, by means of punching, cutting or drilling. For the case shown in FIG. 3, it is also possible to cut off the clamped ends of the hollow sections instead of the cap region 26 and to open the annular gap 4 in this way.

After the annular gap 4 has been opened and in the state of the hollow section shown in FIG. 2, the intermediate layer 5 can be removed from the annular gap 4. Where the intermediate layer 5 is composed of a salt, it can simply be dissolved physically by means of water or chemically by means of an appropriate solution and flushed out of the annular gap 4, leaving an air gap 29 (FIG. 4). The use of a chemical solution to break down or dissolve the intermediate layer is also possible for a medium such as wax, plastic or ice, but the speed of dissolution is low. If the process time is to be as short as possible, this approach may not be preferred. A significantly quicker method for removing the intermediate layer 5 if it is composed of wax, ice, metal or plastic is by heat-treating the hollow section 1. However, the temperatures produced should only be such that the hollow section 1 remains dimensionally accurate. In the case of ice and wax, only slight increases in temperature above room temperature are necessary to liquefy them. To convert plastic and metal from the solid to the liquid state, significantly higher temperatures are of course required, and, for the sake of practicality, as already discussed, the metal of the intermediate layer must melt at a lower temperature than the material of the hollow section. In the case of plastic, it is also possible, especially when using a thermally volatile material such as polyethylene, to convert it directly from the solid state to the gaseous state. This can be accomplished in a simple manner after installation in the exhaust line in the warm-up phase of the internal combustion engine, for example, and, in the case of the embodiment shown in FIG. 2, it is not even necessary to have holding fixtures for the inner or outer hollow section 2, 3 during installation. In the liquid or gaseous state of the medium of the intermediate layer 5 after heat treatment in a furnace or by means of a hot air gun, the medium is discharged from the annular gap 4, leaving the air gap 29, the overall production process thus resulting in the final form of the hollow section 1.

For further processing of the hollow section 1 or assembly with other components, these components preferably being insulated by means of an air gap, a holding fixture is required in the case of unclamped hollow sections 2, 3 to hold the inner hollow section 2 in a defined position in the outer hollow section 3 without changing the width of the air gap.

It also should be noted that, within the context of the invention, the hollow section 1 does not have to be rectilinear and tubular before the internal high-pressure forming step. It is possible for the tubular external shape of the hollow section 1 to be subjected to a process of forming that involves bending. Almost any cross-sectional shape is possible for the two hollow sections 2, 3, and they do not have to be the same. When choosing the shape, however, it is a prerequisite that it should be possible to insert the inner hollow section 2 into the outer hollow section and that a gap 4 is formed between the hollow sections 2, 3 in the process. For this purpose, both the inner hollow section 2 and the outer hollow section 3 can be subjected to preworking, e.g. by squashing or indenting, or to preprofiling. This makes it possible to tailor the gap, which does not necessarily have to be the same width over the length of the hollow section 1 but can have a different width at specific points depending on requirements. The thickness of the intermediate layer 5 is therefore likewise adapted to match.

It is also possible to feed extra hollow-section material towards the expansion zone, i.e. towards the neck 25, by means of the axial rams 11, 12 or 21, 22 during the expansion of the hollow section 1 by means of internal high pressure in order to increase process reliability by avoiding thinning of the material. In the embodiment according to the invention, the process of supplying extra material as discussed is particularly reliable since, thanks to the semi-integral nature and simultaneous spacing of the two hollow sections 2,3, there is no friction between them, which would otherwise cause folding and buckling.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Method for the production of double-walled hollow sections by means of internal high-pressure forming, a first hollow section being inserted into a second hollow section, after which the double-walled hollow section thus formed is subjected to high internal fluid pressure in such a way in an internal high-pressure forming die that the double-walled hollow section is expanded, and an air gap being formed between the first, inner, hollow section and the second, outer, hollow section, the improvement comprising:

the inner hollow section is positioned in a defined manner in the outer hollow section during insertion, forming a gap, in that an intermediate layer is introduced between the inner hollow section and the outer hollow section, filling the gap, and in that, after expansion of the double-walled hollow section by internal high-pressure forming, the intermediate layer is dissolved out of the hollow section via an opening formed at least in one of the hollow sections, thus opening up the gap and forming the air gap.

2. Method according to claim 1, wherein the inner hollow profile is positioned in such a way in the outer hollow profile that the gap forms an annular gap that surrounds the inner hollow section all the way round.

3. Method according to claim 1, wherein, with the two hollow sections in the position into which they have been slid, a fluid medium is introduced into the gap, filling the gap, and in that, after filling the gap to form the intermediate layer, the medium is solidified from the fluid state by cooling.

4. Method according to claim 1, wherein, before forming, in the position into which the two hollow sections have been slid, a sleeve that can be dissolved while the shape of the hollow sections remains the same is introduced into the gap between the hollow sections, filling the gap over the length of the hollow sections and forming the intermediate layer.

5. Method according to claim 1, wherein, before being inserted into the outer hollow profile, the inner hollow profile is coated to form a soluble coating, the thickness of the soluble coating serving as an intermediate layer corresponding approximately to the thickness of the gap.

6. Method according to claim 1, wherein, before forming, a sleeve, which forms the intermediate layer, which can be dissolved while the shape of the hollow sections remains the same and the wall thickness of which corresponds approximately to the thickness of the gap, is pushed onto the inner hollow section outside the forming die and is then inserted as a unit with the said hollow section into the outer hollow section.

7. Method according to claim 1, wherein, after forming, the intermediate layer is dissolved physically or chemically and then flushed out of the gap.

8. Method according to claim 1, wherein, after forming, the solid intermediate layer is converted into the liquid and/or gaseous state by means of a heat treatment and is discharged from the gap in this state.

9. Method according to claim 1, wherein the opening in the respective hollow section is produced outside the forming die only after forming.

10. Method according to claim 1, wherein that the two nested hollow sections are clamped to one another at the ends during forming by action upon axial rams inserted into the inner hollow section, closing the gap.

11. A method for manufacturing an air-gap-insulated exhaust pipe for use in a vehicle exhaust line, comprising:

(a) positioning an inner hollow pipe within an outer hollow pipe such that a gap is formed between the inner pipe and the outer pipe;

(b) providing an intermediate layer in the gap between the inner pipe and the outer pipe to form a double-walled pipe with the intermediate layer;

(c) expanding at least a portion of both walls of the double-walled pipe by internal high-pressure forming; and then (d) removing the intermediate layer to form an air gap between the inner pipe and the outer pipe.

12. The method according to claim 11, wherein the inner pipe is positioned within the outer pipe such that an at least substantially uniform gap is formed between inner pipe and outer pipe.

13. The method according to claim 11, further comprising, in step b, providing the intermediate layer between the inner pipe and outer pipe by introducing a fluid medium into the gap, filling the gap, and solidifying the medium.

14. The method according to claim 11, further comprising, in step b, providing the intermediate layer between the inner pipe and the outer pipe by introducing a sleeve into the gap, wherein the sleeve is capable of being dissolved and, in step d, further comprising removing the intermediate layer by dissolving the sleeve.

15. The method according to claim 11, further comprising, prior to step a, providing the intermediate layer of step b by coating an outer side of the inner pipe with a coating, wherein the coating serves as the intermediate layer and is of sufficient thickness to substantially fill the gap between the inner pipe and outer pipe.

16. The method according to claim 11, further comprising, prior to step a, providing the intermediate layer of step b by placing a sleeve on the inner pipe, wherein the sleeve serves as the intermediate layer and is of sufficient thickness to substantially fill the gap between the inner pipe and outer pipe, wherein the sleeve is capable of being dissolved, and further comprising positioning the inner pipe surrounded by the sleeve, together, within the outer pipe such that the sleeve fills the gap that would otherwise exist between the inner pipe and outer pipe.

17. The method according to claim 11, further comprising in step d dissolving the intermediate layer and removing the dissolved intermediate layer from the gap.

18. The method according to claim 11, further comprising in step d using heat treatment to remove the intermediate layer.

19. The method according to claim 11, further comprising in step c forming a branch stub in the double-walled pipe.

20. The method according to claim 11, further comprising after step c but before step d, creating an opening in the double-walled pipe to provide access to the intermediate layer.

21. The method according to claim 20, wherein an opening is created by a method selected from the group consisting of punching, cutting, or drilling.

22. The method according to claim 11, further comprising clamping together corresponding ends of the inner pipe and the outer pipe with axial rams inserted into the inner pipe, in conjunction with step c, such that the gap is closed.

23. An apparatus for manufacturing an air-gap-insulated exhaust pipe for use in a vehicle exhaust line, comprising:

(a) means for positioning an inner hollow pipe within an outer hollow pipe such that a gap is formed between the inner pipe and the outer pipe;

(b) means for providing an intermediate layer in the gap between the inner pipe and the outer pipe to form a double-walled pipe with the intermediate layer;

(c) means for expanding at least a portion of the double-walled pipe by high-pressure forming; and (d) means for removing the intermediate layer to form an air gap between the inner pipe and the outer pipe.

* * * * *